US006085061A

United States Patent [19]

Snelling

[11] Patent Number: 6,085,061

[45] Date of Patent: Jul. 4, 2000

[54] ACTIVE ELECTROSTATIC CLEANING BRUSH

[75] Inventor: Christopher Snelling, East Rochester, N.Y.

[73] Assignee: Xerox Corporation, Stamford, Conn.

[21] Appl. No.: 09/218,244

[22] Filed: Dec. 22, 1998

[51] Int. Cl.[7] ..... G03G 21/00

[52] U.S. Cl. ..... 399/353; 15/1.51; 310/800

[58] Field of Search ..... 399/353, 354, 399/355; 15/1.51; 310/800; 428/373, 394

[56] References Cited

U.S. PATENT DOCUMENTS 4,272,184 6/1981 Rezanka ..... 399/356
4,303,733 12/1981 Biille et al. ..... 428/367
4,705,387 11/1987 Lin ..... 355/15
5,520,977 5/1996 Snelling ..... 428/36.9

FOREIGN PATENT DOCUMENTS 3-280046 12/1991 Japan .

*Primary Examiner*—Joan Pendegrass

[57] ABSTRACT

Apparatus for removing residual charged particles from a charge retentive surface characterized by a self-biasing electrostatic cleaner brush and a flicker bar. The brush includes fibers made of a bi-layer of PVDF films; one of which is PVDF covered over a conductive core. Upon bending in one direction, the fiber will generate an electrical potential which will attract and hold oppositely charged toner, which will then be released when the fiber is flexed by the flicker bar in the opposite direction.

14 Claims, 4 Drawing Sheets

ACTIVE ELECTROSTATIC CLEANING BRUSH

BACKGROUND OF THE INVENTION

Cross-reference is hereby made to commonly assigned and copending U.S. application Ser. No. 09/219,725, entitled Xeromorph Electrostatic Cleaning Brush, filed Dec. 22, 1998 by Christopher Snelling and Dale Mashtare, and U.S. application Ser. No. 09/218,672, entitled Cleaning Brush Using the Pyroelectric Effect, filed Dec. 22, 1998 by Dale Mashtare and Christopher Snelling.

This invention relates to a printing apparatus and more particularly to a cleaning apparatus for removing residual particles, such as, toner from a charge retentive surface forming a part of the printing apparatus with subsequent removal of the toner particles from the cleaning apparatus.

In printing arts of the type contemplated, one method of forming images is using a charge retentive surface such as a photoreceptor or photoconductor. It comprises a photoconductive insulating material adhered to a conductive backing which is charged uniformly. Then the photoreceptor is exposed to a light image of an original document to be reproduced. The latent electrostatic images, thus formed, are rendered visible by applying any one of numerous pigmented resins specifically designed for this purpose. In this case of a reusable photoreceptor, the pigmented resin, more commonly referred to as toner which forms the visible images is transferred to plain paper. After transfer, the toner images are made to adhere to the copy medium usually through the application of heat and pressure by means of a roll fuser.

Although a preponderance of the toner forming the images is transferred to the paper during transfer, some toner remains on the photoreceptor surface, it being held thereto by relatively high electrostatic and/or mechanical forces. It is essential for optimum operation that the toner and debris remaining on the surface be cleaned thoroughly therefrom.

A commercially successful mode of cleaning employed in automatic xerography utilizes a brush with soft bristles which have suitable triboelectric characteristics. While the bristles are soft they are sufficiently soft to remove residual toner particles from the xerographic plate. In addition, webs or belts of soft fibrous or tacky materials and other cleaning systems are known.

More recent developments in the area of removing residual toner and debris from a charge retentive surface have resulted in cleaning structures which, in addition to relying on the physical contacting of the surface to be acted upon also rely on electrostatic fields established by electrically biasing one or more members of the cleaner system.

It has been found that establishing an electrostatic field between the charge retentive surface and the cleaning member such as a fiber brush or a magnetic brush enhances toner attraction to the cleaning brush surface. Such arrangements are disclosed in U.S. Pat. Nos. 3,572,923, and 3,722,018 granted to Fisher et al. on Mar. 22, 1973 and Fisher on Mar. 30, 1971, respectively. Likewise, when an electrostatic field is established between the brush and a brush detoning member, removal of toner from the brush is improved, as shown in, for example, U.S. Pat. No. 4,705,387. The creation of the electrostatic field between the brush and photoreceptor is accomplished by applying a D.C. voltage to the brush. When the fibers of granules forming the brush are electrically conductive and a bias is applied thereto cleaning is observed to be more efficient than if the fibers are non-conductive or insulative.

In accordance with the improved features of the present invention, there is provided an active electrostatic cleaning brush for removing toner particles from a surface with subsequent separation of particles having a predetermined diameter and charge from the cleaning brush. In one embodiment, the active electrostatic cleaning brush is made of flexible piezoelectric fibers. The brush fibers are made in one embodiment from a bi-layer plastic; one of which is poled polyvinylidenefluoride (PVDF) covered over a conductive core. Upon bending, the fiber will generate an electrostatic potential on its surface that will attract and hold oppositely charged toner, which will then be released when the fiber is flexed in an opposite direction.

In another embodiment, the active electrostatic cleaning brush includes a hub and flexible fibers extending from the hub. The flexible fibers comprise a bi-layer of polyvinylidene fluoride film supported by a grounded conductive member.

Other aspects of the present invention will become apparent as the following description proceeds with reference to the drawings in which.

As indicated hereinabove, the present invention provides a novel active electrostatic cleaning brush for use in an electrostatographic printing machine. While the present invention will be described with reference to a preferred embodiment thereof, it will be understood that the invention is not limited to this preferred embodiment. On the contrary, it is intended that the present invention cover all alternatives, modifications, and equivalents as may be indicated within the spirit and scope of the invention as defined by the appended claims. Other aspects and features of the present invention will become apparent as the description proceeds.

Figure 4:
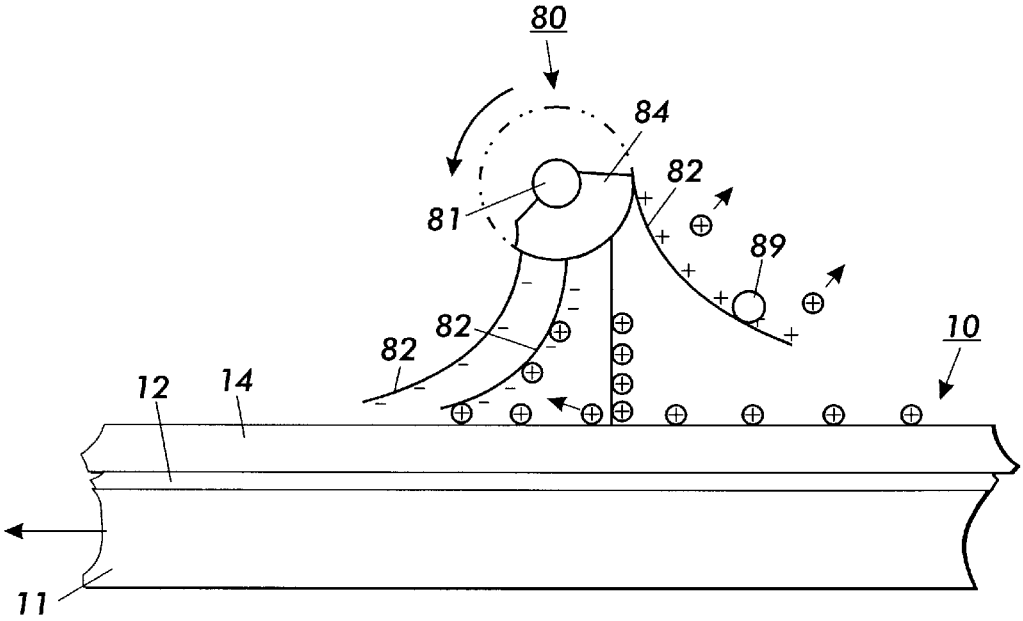
FIG. 4 is an elevational view illustrating the novel active electrostatic cleaning brush bimorph fibers.
Figure 5:
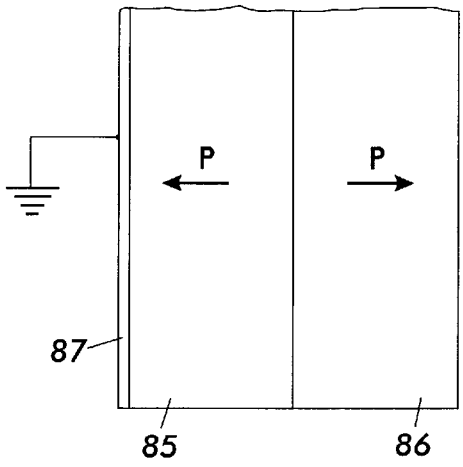
FIG. 5 is an elevational view of a single PVDF active electrostatic cleaning brush of FIG. 4.

Referring now to FIG. 4, an active electrostatic cleaning brush 80 in accordance with the present invention is shown in a cleaning configuration against the surface of a photoconductor of a typical electrostatographic printing machine. As can be seen from FIG. 4, the active electrostatographic cleaning brush 80 is in operative engagement with photoconductive belt 10 which consists of an electrically conductive substrate 11, a charge generator layer 12 comprising photoconductive particles randomly dispersed in an electrically insulating organic resin and a charge support layer 14 comprising a transport electrically inactive polycarbonate resin having dispersed therein one or more diamides. Belt 10 moves in the direction of arrow 16 to advance successive portions thereof sequentially throughout the various processing stations disposed about the path of movement thereof It can be seen from FIG. 4 that electrostatic cleaning brush 80 comprises a hub member 81 with a series or plurality of fibers 82 attached thereto. A detoning member, in this instance a flicker bar 89 is provided for detoning toner particles adhered to the fibers by initial stripping as the brush fibers 82 impact the flicker bar 89. The brush fibers 82 comprise a surface layer as shown in FIG. 5 of a piezoelectric film, such as, poled polyvinylidene fluoride (PVFD) film. Preferably Kynar® piezo film manufactured by Penwalt KTM. Two sheets of PVFD film 85 and 86 of about 110 microns are shown in FIG. 5 that are mounted on a grounded conductive surface 87 and polarized in opposite directions.

Figure 1:
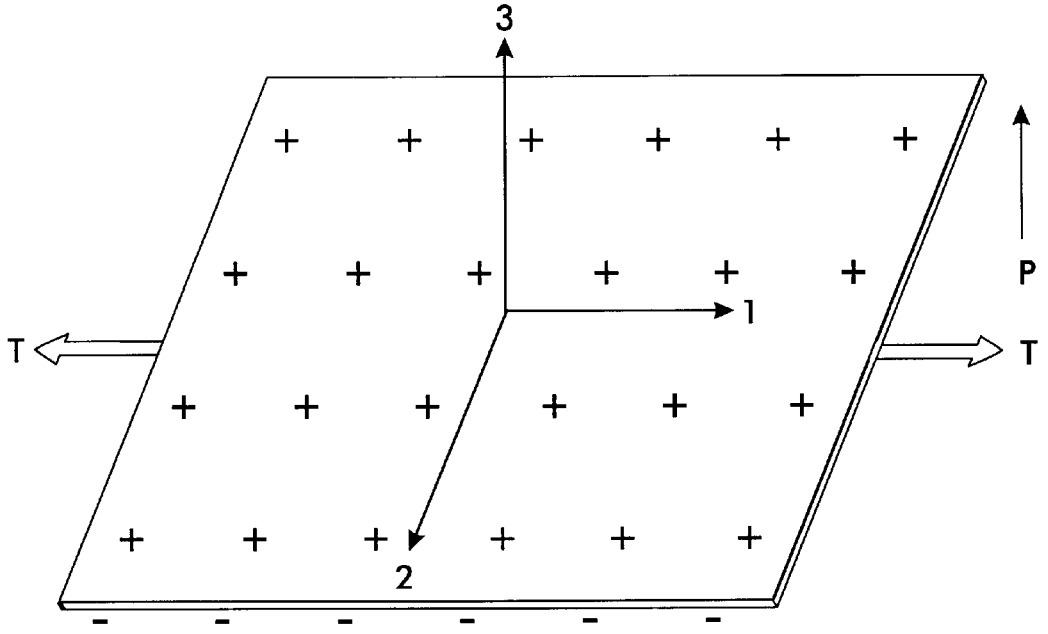
FIG. 1 PRIOR ART
FIG. 1 is a perspective view illustrating the geometry of a prior art piezoelectric sheet.

Piezoelectric materials are formed by stretching PVFD film in one direction and applying a large electric field to electrically polarize it in a direction perpendicular to the film. As shown in FIG. 1, the stretch direction is denoted by "1" and the polarization direction is noted by "3". When a PVDF sheet is strained, it develops an internal electric field, which is proportioned to the deformation, as shown in U. S. Pat. No. 5,520,977 which is incorporated herein by reference to the extent necessary to practice the present invention.

Figure 2:
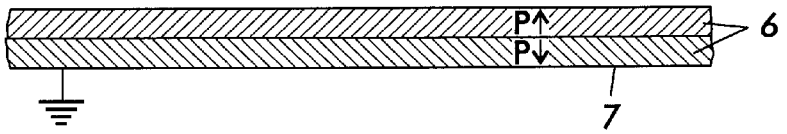
FIG. 2 PRIOR ART
FIG. 2 is an elevational view illustrating a prior art (bimorph) Xeromorph sheet which is utilized in the present invention.
Figure 3:
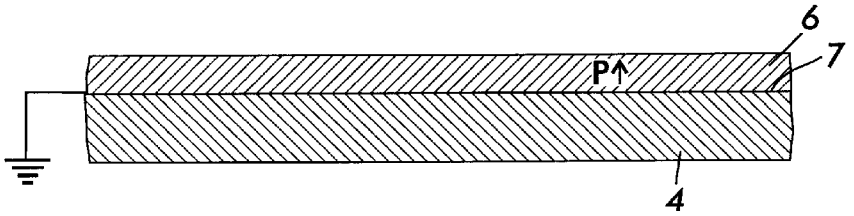
FIG. 3 PRIOR ART
FIG. 3 is an elevational view illustrating a prior art (unimorph) Xeromorph sheet which is utilized in the present invention.

The present invention utilizes either a bimorph or a unimorph structure referred to as "Xeromorph". A bimorph Xeromorph consists of two PVDF sheets 6 laminated together with each sheet polarization direction opposed to each other having only a bottom electrode 7, as shown in FIG. 2. A unimorph Xeromorph consists of a single PVDF sheet 6 laminated to a thick substrate 4 as shown in FIG. 3. The substrate material may comprise materials which can be bent, and have no piezoelectric properties.

Self-biasing active electrostatic cleaning brush 80 of the present invention is based upon the piezoelectric effect in flexible Xeromorph brush fibers 82. Direction and degree of fiber fixtures as they sweep along the surface of photoconductive belt 10 and then impact flicker bar 89 determine the instantaneous polarity and magnitude of net surface charge on the fibers to initially attract and to subsequently repel toner particles from the brush. As a result, the piezoelectric effect is utilized to achieve electrostatic enhancement of brush performance without the need for a power supply. In fact, the ability of Xeromorph "like" ferroelectric polymer brush fibers to generate net surface charge (potential) of between 200–2000 v as the result of flexure is employed as a supplement to mechanical forces to improve brush cleaning and detoning efficiency. For example, as shown in FIG. 4, Xeromorph brush fibers 82 have an initial net surface charge as photoconductor 10 is contacted for cleaning purposes and thereby attracts oppositely charged toner particles to the fibers. However, as hub 81 continues to rotate in a counter clockwise direction, the fibers 82 contact flicker bar 89 causing the Xeromorph fibers to exhibit reversed surface charge polarity and thereby repel the positive charged toner particles from the brush.

In operation, Xeromorph fibers 82 are sufficiently elastic and resilient to compressive forces as the brush fibers are brought into contact with photoconductor 10, upon which the powder toner image is located. The compressive force causes deformation of the piezoelectric fibers such that an electrical potential is generated on the surface of the fibers causing them to attract oppositely charged toner particles away from the surface of photoconductor 10. After the fibers leave the surface of photoconductor 10, with toner particles now adhered thereto, they contact flicker bar 89 which causes a change in polarity of the net surface charge on the fibers. Therefore, in addition to the mechanical release of toner from the fibers due to the fibers contacting flicker bar 89, the surface charges on the fibers change polarity and thus repel toner particles therefrom. It should be understood that even without flicker bar 89 brush fibers 82 will go into oscillating motion after striking the surface of photoconductor 10, and thereby repel toner particles. Toner particles may also be extracted from photoconductor 10 with a detone roll or by the use of a vacuum source.

It will be evident from the present description that deforming the fibers against the photoconductive surface 10 can be increased such that higher fiber potentials can be applied to achieve high cleaning efficiencies, if necessary.

Figure 6A:
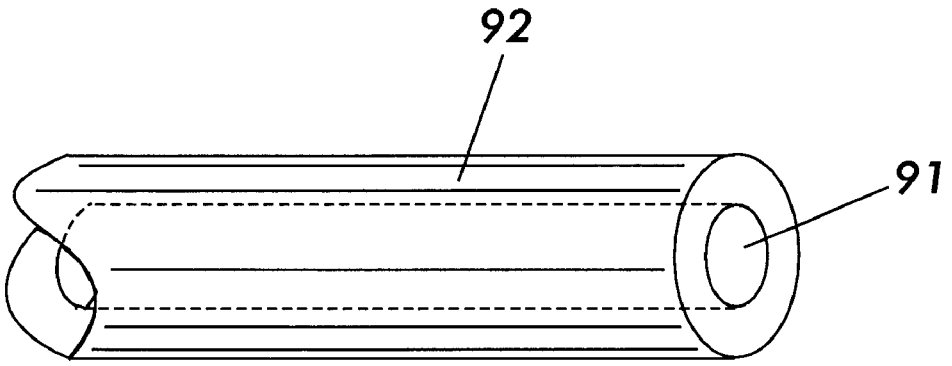
FIGS. 6A and 6B are elevational views illustrating an alternative novel electrostatic cleaning brush using a PVFD co-polymer coating.
Figure 6B:
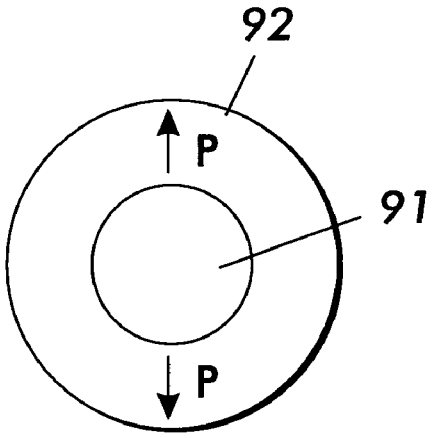

An alternative embodiment of the present invention is shown in FIGS. 6A and 6B and comprises coating conductive brush fibers of an electrostatic brush with PVFD co-polymer materials. This is followed by polarization of the co-polymer material to introduce the desired electrostatic field/potential effects. As shown in FIGS. 6A and 6B, a conductive fiber core 91 is surrounded by a PVFD co-polymer 92 and polarized in the directions P as shown by the arrows in FIG. 6B. The PVFD is polarized such that the fibers 90 of a brush flexed due to contact with photoconductor 10 being cleaned will create net surface charge opposite in polarity to the charge being cleaned from the photoconductor 10. Subsequent fiber deflections in the opposite direction will create brush fibers net charge polarity the same as charge on the toner particles. To enhance cleaning of bi-modal toners (i.e., having both charge polarities) a composite brush is contemplated that could include fibers polarized in the opposite direction as well.

Figure 7:
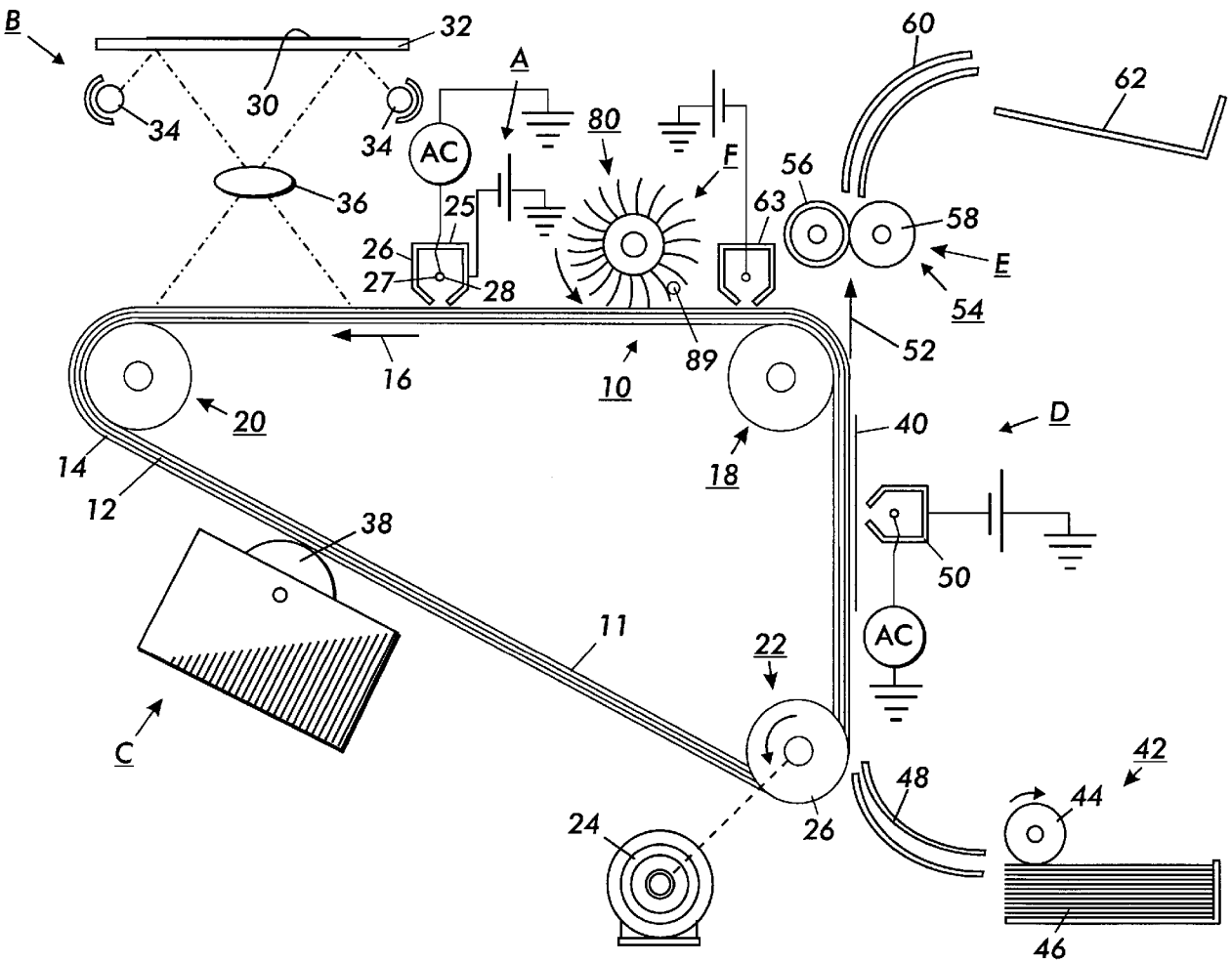
FIG. 7 is a schematic elevational view depicting an electrophotographic printing machine incorporating the active electrostatic cleaning brush of the present invention.

As shown in FIG. 7, belt 10 is entrained about stripping roller 18, tension roller 20 and drive roller 22. Roller 22 is coupled to motor 24 by suitable means such as a drive chain.

Belt 10 is maintained in tension by a pair of springs (not shown) resiliently urging tension roller 20 against belt 10 with the desired spring force. Both stripping roller 18 and tension roller 20 are rotatably mounted. These rollers are idlers, which rotate freely as belt 10 moves in the direction of arrow 16.

With continued reference to FIG. 1, initially a portion of belt 10 passes through charging station A. At charging station A, a corona device, indicated generally by the reference numeral 25, charges layer 14 of belt 10 to a relatively high, substantially uniform negative potential. A suitable corona generating device for negatively charging the photoreceptor belt 10 comprises a conductive shield 26 and corona wire 27 the latter of which is coated with an electrically insulating layer 28 having a thickness which precludes a net d.c. corona current when an a.c. voltage is applied to the corona wire. Application of a suitable d.c. bias on the conductive shield 26 will result in a suitable charge being applied to the photoreceptor belt as it is advanced through exposure station B. At exposure station B, an original document 30 is positioned face down upon a transparent platen 32. The light rays reflected from original document 30 form images, which are transmitted through lens 36. The light images are projected onto the charged portion of the photoreceptor belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoreceptor belt.

Belt 10 then advances the toner powder image to transfer station D. At transfer station D, a sheet of support material 40 is moved into contact with the toner powder images. The sheet of support material is advanced to transfer station D by a sheet forming apparatus 42. Preferably, sheet feeding apparatus 42 includes a feed roll 44 contacting the upper sheet of stack 46. Feed roll 44 rotates so as to advance the upper most sheet from stack 46 into chute 48. Chute 48 directs the advancing sheet of support material into contact with the belt 10 in a timed sequence so that the toner sequence so that the toner powder image developed thereon contacts the advancing sheet of support material at transfer station D.

Transfer station D includes a corona generating device 50 which sprays ions of suitable polarity onto the backside of sheet 40 so that the toner powder images are attracted from photoconductor belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with toner powder images contacting fuser roller 56. In this manner, the toner powder image is permanently affixed to sheet 40. After fusing, chute 60 guides the advancing sheet 40 to catch tray 62 for removal from the printing machine by the operator.

A preclean dicorotron 63 is provided for exposing the residual toner and contaminants to positive charges thereon so that a suitable biased cleaning roller, to be discussed hereinafter, will be more effective in removing them.

At cleaning station F, residual particles such as toner and contaminants or debris such as paper fibers are removed from the photoreceptor surface by means of active electrostatic cleaning brush 80 which is self biased due to the piezoelectric effect in the flexible Xeromorph brush fibers 82. The ability of the Xeromorph ferroelectric polymer fibers to generate net positive surface charge as a result of flexure as shown in FIG. 4 is used to attract negatively charged toner particles to the brush fibers from the upper surface of belt 10.

A detoning structure 89 is provided to continuously remove the residual particles from the brush fibers 82 so that they can continue to be effective in removing the particles from belt 10. As brush fibers 82 contact detoning structure 89, they are flexed in an opposite direction, which causes each of them to exhibit a negative net surface charge. This negative brush fiber surface charge will now repel the negative charged toner particles adhered to the fibers.

It should now be appreciated that an improved power supplyless active electrostatic cleaner brush made of flexible piezoelectric fibers has been disclosed which is capable of effectively separating toner from a charge retentive surface.

What is claimed is:

1. Apparatus for removing charged particles comprising toner particles from a charge retentive surface, said apparatus comprising:

a hub; and flexible fibers extending from said hub, said flexible fibers including a piezoactive polymer covered over a conductive core, whereby bending of said fibers as said fibers contact and release with said charge retentive surface in cleaning relationship thereto, generates a external electric field suitable for respectively attracting toner to said fibers and releasing toner from said fibers during a cleaning process.

2. The apparatus of claim 1, including a detoning member, said detoning member being positioned to be contacted by said flexible fibers, and wherein rotation of said hub in a predetermined direction causes said flexible fibers to contact said detoning member and bend in a predetermined direction.

3. The apparatus of claim 1, wherein said electrical potential is from about 200 to about 2000 volts.

4. Apparatus for removing charged toner particles from a charge retentive surface, said apparatus comprising:

a hub; and flexible fibers extending from said hub, and wherein said flexible fibers comprise a bi-layer of polyvinylidene fluoride film supported by a grounded conductive member.

5. The apparatus of claim 4, wherein said bi-layer of polyvinylidene fluoride film is oppositely charged.

6. The apparatus of claim 5, wherein rotation of said hub in a predetermined direction causes said flexible fibers to contact the charge retentive surface and bend in a first direction and thereby attract oppositely charged toner particles from the charge retentive surface.

7. The apparatus of claim 6, including a detoning member, said detoning member being positioned to be contacted by said flexible fibers, and wherein rotation of said hub in said predetermined direction causes said flexible fibers to contact said detoning member and bend in a second direction.

8. The apparatus of claim 7, wherein bending of said flexible fibers in said first or second directions generate an electrical potential on an outside surface of said flexible fibers.

9. The apparatus of claim 8, wherein said electrical potential is from about 200 to about 2000 volts.

10. A printing apparatus for printing page image information onto copy sheets including a charge retentive surface, an imaging zone where images are placed onto the charge retentive surface, a development zone where the images on the charge retentive surface are developed with toner particles, a transfer zone where the developed imaged is transferred onto copy sheets, and a cleaning zone where residual toner particles are removed from the charge retentive surface, the cleaning zone comprising:

a hub; and flexible fibers extending from said hub and adapted to contact a charge retentive surface, and wherein said flexible fibers comprise a multi-layered piezoelectric material mounted on a grounded conductive substrate, said multi-layered piezoelectric material includes a first layer of piezoelectric polymer film having a first polarization direction and a second piezoelectric polymer film disposed on said first piezoelectric polymer film having a second polarization direction.

11. The apparatus of claim 10, wherein rotation of said hub in a predetermined direction causes said flexible fibers to contact the charge retentive surface and bend in a first direction and thereby attract oppositely charged toner particles from the charge retentive surface.

12. The apparatus of claim 11, including a detoning member, said detoning member being positioned to be contacted by said flexible fibers, and wherein rotation of said hub in said predetermined direction causes said flexible fibers to contact said detoning member and bend in a second direction.

13. The apparatus of claim 12, wherein bending of said flexible fibers in said first or second directions generate an electrical potential on an outside surface of said flexible fibers.

14. The apparatus of claim 13, wherein said electrical potential is from about 200 to about 2000 volts.

* * * * *